US006527345B2

(12) United States Patent
Lidkea et al.

(10) Patent No.: US 6,527,345 B2
(45) Date of Patent: Mar. 4, 2003

(54) METHOD FOR EXCAVATING A TUNNEL ROCK FACE BY DRILLING A PATTERN OF LIFTER AND LINE HOLES

(75) Inventors: Wayne N. Lidkea, Lively (CA); Gregory Robert Baiden, Lively (CA)

(73) Assignee: Inco Limited, Toronto (CA)

( * ) Notice: Subject to any disclaimer, the term of this patent is extended or adjusted under 35 U.S.C. 154(b) by 49 days.

(21) Appl. No.: 09/853,025

(22) Filed: May 10, 2001

(65) Prior Publication Data

US 2002/0167215 A1 Nov. 14, 2002

(51) Int. Cl.[7] ..... E21C 37/00

(52) U.S. Cl. ..... 299/13; 102/311; 102/312; 102/313

(58) Field of Search ..... 299/13; 102/311–313

(56) References Cited

U.S. PATENT DOCUMENTS 4,611,856 A 9/1986 Cha et al. ..... 299/2

5,232,268 A 8/1993 Dengler et al. ..... 299/13

FOREIGN PATENT DOCUMENTS

RU 1120760 * 5/1985 ..... 299/13

* cited by examiner

*Primary Examiner*—David Bagnell
*Assistant Examiner*—Sunil Singh
(74) *Attorney, Agent, or Firm*—Edward A. Steen

(57) ABSTRACT

A method for excavating a tunnel rock face by drilling a pattern of lifter holes and line holes. The line holes ensure the grade or slope of the excavation meets specification while reducing the need for cleaning out the face. A longitudinal band of lifter holes is drilled into the tunnel face at an acute angle in relation to the substantially perpendicular reference axis emerging from the tunnel face. A series of line holes, disposed opposedly adjacent to the lifter holes, are drilled at a smaller acute angle. The lifter holes are drilled deeper than the line holes and they do not intersect. Explosives are loaded into the lifter holes. The line holes are expendable and encourage fracturing of the rock.

7 Claims, 3 Drawing Sheets

METHOD FOR EXCAVATING A TUNNEL ROCK FACE BY DRILLING A PATTERN OF LIFTER AND LINE HOLES

TECHNICAL FIELD

The present invention relates to drilling and blasting in general and, more particularly, to an expeditious method for excavating a tunnel without the need for cleaning lifter holes.

BACKGROUND ART

Hard rock mining, tunneling and shaft sinking are difficult and expensive endeavors fraught with skill, safety and time considerations.

Considerable effort has been expended in improving the efficiency of tunneling operations. Over the years, new and improved techniques, equipment and blasting regimens have been proposed and implemented to increase underground safety and productivity. Yet the fact remains that hard rock excavating is a tough undertaking. Every bit of the hard earned progress inures to the benefit of industry, society and personnel.

When an improved drilling and blasting technique is used for excavation, a reduction in cycle time increases advance rates, safety and improves overall economic benefits.

One area of concern is the reduction of cycling times. By eliminating activities that consume or occupy but not directly contribute to the advance of tunnel face, additional efficiencies maybe realized.

Using present drilling and blasting techniques, operators must manually locate, dig out and clean lifter holes. Lifter holes (also known as blast holes) are drilled holes oriented along the floor of a tunnel in the direction of the advance and are required to ensure the grade or slope of the tunnel meets design specifications. Explosives are loaded into the lifter holes.

During tunnel driving prior to the insertion of explosives, the lifter holes get filled with mud, cuttings, debris, etc., and become buried. The entire heading must be then manually shoveled out to gain access to the holes. The lifter holes must be literally dug out and cleaned by hand—a long laborious process.

In order to eliminate or reduce the time and money wasting paradigm of cleaning or mucking lifter holes, a research project was initiated with the objective to perfect a technique that would ensure a drift floor could be reliably excavated without the need to dig out, clean and load lifter holes.

U.S. Pat. No. 5,232,268 to Dergler et al., suggests a method for tunneling by drilling a large diametered central relief hole surrounded by a series of smaller diameter concentric substantially axially parallel primary and secondary blast holes. Explosives are placed in the relief hole and in most, if not all, of the primary and secondary holes. The central relief hole is drilled deeper than the other holes. The inventors state that by using their methodology, the difficult prior practice of drilling exactly parallel holes is replaced by approximately axially parallel relief holes.

U.S. Pat. No. 4,611,856 to Cha et al., teaches the use of parallel blast holes. Although shale oil recovery is markedly different than hard rock mining, the patent demonstrates the use of "parallel rows of holes extending across the horizontal cross-section of the retort site" Col. 6, line 26. Angled drill holes at the base of the retort permit the formation of the tapered lower portion of the retort.

The aforementioned references provide examples of prior art parallel drilling techniques. There is no recognition of the hard rock problems encountered with lifter holes.

SUMMARY OF THE INVENTION

There is provided a technique for excavating hard rock stopes, drifts, tunnels, shafts and the like by drilling an array of closely spaced concentrated line drill holes at the base of the rock face. These line drill holes may be slightly angled with respect to the blast holes. Not loaded with explosives, these line drill holes are "expendable" and act as crack indications where compression waves generated from the nearest blast hole are reflected and concentrated as tensile waves used to fail the rock between a predetermined plane and a blast hole.

PREFERRED EMBODIMENT OF THE INVENTION

Figure 2:
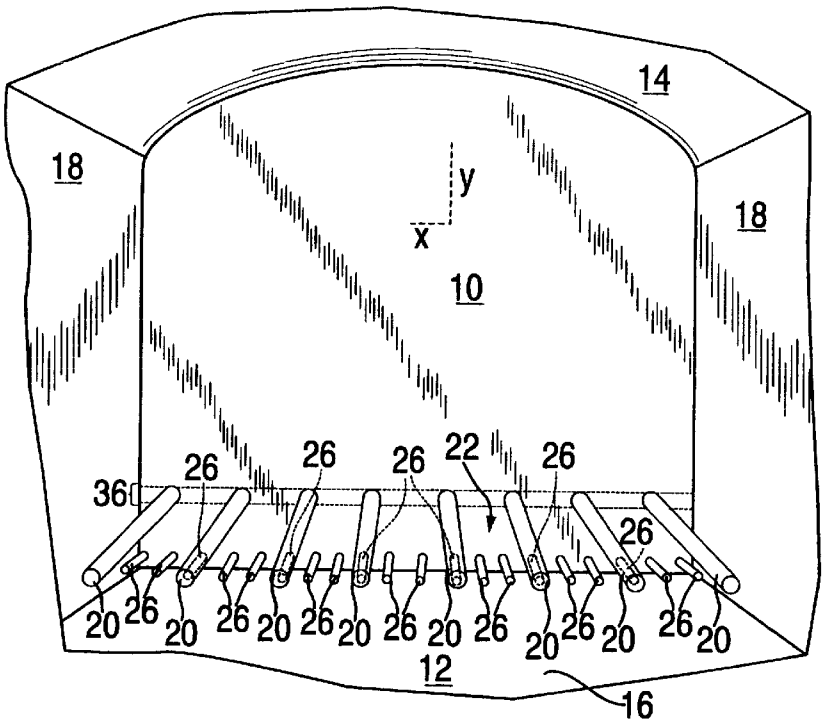
FIG. 2 is a view taken along line 2—2 of FIG. 1.
Figure 1:
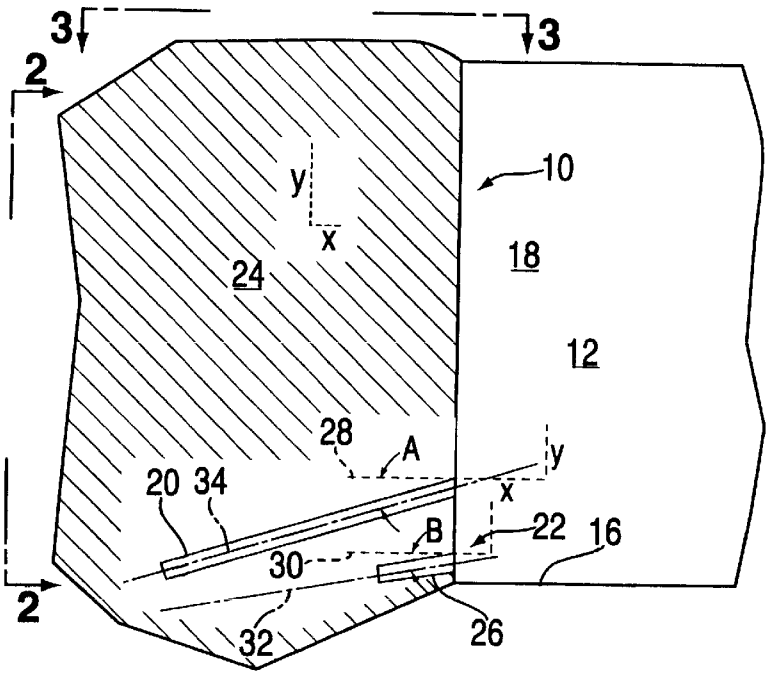
FIG. 1 is a side elevation of a tunnel employing an embodiment of the invention.
Figure 3:
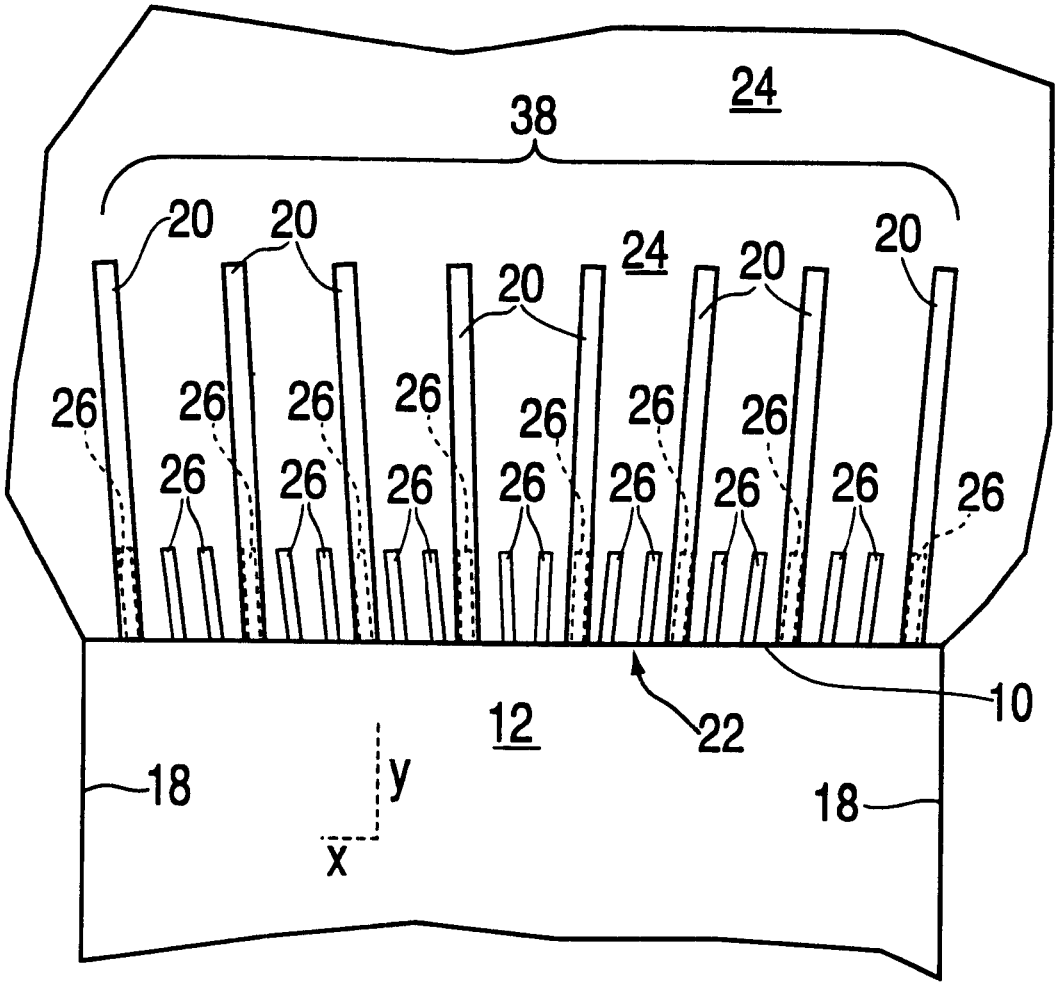
FIG. 3 is a view taken along line 3—3 of FIG. 1.
Figure 4:
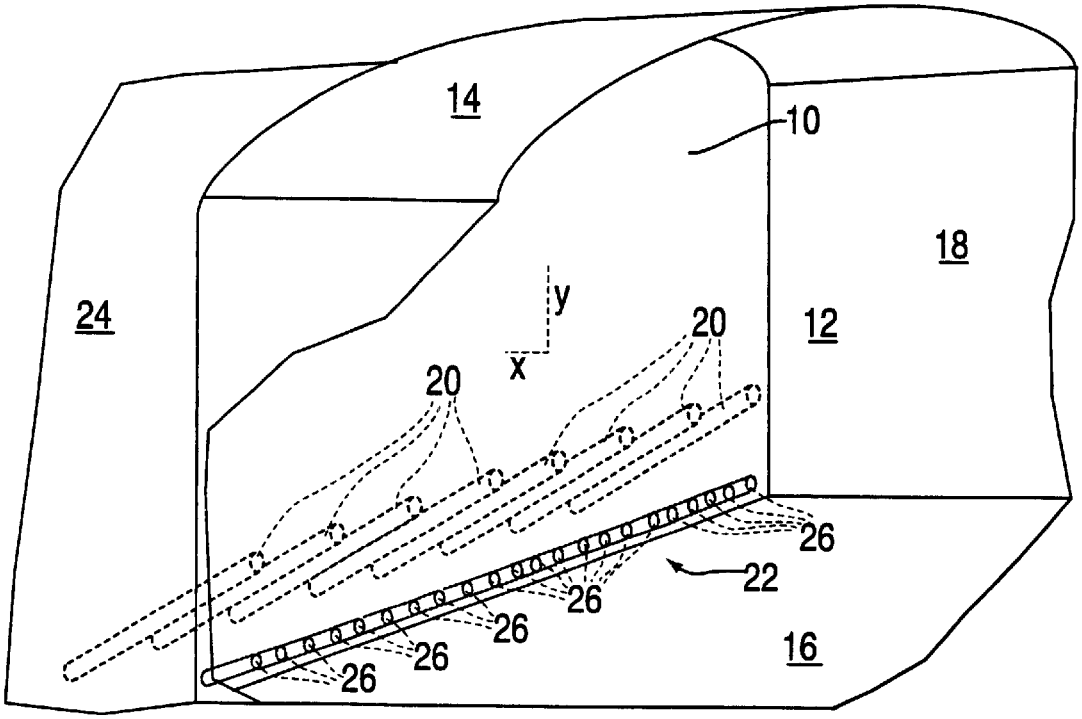
FIG. 4 is an isometric view of FIG. 1.

FIGS. 1, 2 and 3 are simplified elevations of a tunnel face 10 of the end of underground heading 12. In addition to the tunnel face 10, the heading 12 includes a back (or roof) 14, a floor 16 and side walls 18.

The adverb "about" before a series of values, unless otherwise indicated, is applicable to each value in the series.

A plurality of lifter holes 20 are downwardly drilled at an acute pitch angle A of about 8–10% off a fixed horizontal reference axis 28 from the base 22 of the tunnel face 10 into the area of ground or heading 24 to be blasted. The lifter holes 20 are preferably drilled in an array within an elevated longitudinal band 36 spaced above the base 22 of the tunnel face 10.

A plurality of line holes 26 are drilled below and in between the lifter holes 20. The line holes 26 may be drilled at an acute pitch angle B vis-à-vis a second horizontal reference axis 30. Pitch angle B is less than pitch angle A and may be about 3–4%. Both the first and second horizontals 28 and 30 are parallel to one another and are essentially relative frames of axis with respect to an arbitrary horizontal reference X axis perpendicular to a vertical reference Y axis heading of the undergrounding heading 12. The X axis is substantially parallel with the direction of underground heading 12 and emerges (or enters) the tunnel face 10. The Y axis, normal to the X axis, is substantially parallel with the tunnel face 10. In the non-limiting embodiments as shown in FIGS. 1–4, the first and second horizontals 28 and 30 are co-incident with the X axis.

The lifter holes 20 are longer than the line holes 26. The depth and spacing of the lifter holes and line holes 26 are functions of the ground conditions of the heading 12. It is preferred to have up to several times (about 2–4) the number of line holes 26 compared to the number of lifter holes 20.

It is preferred to drill the lifter holes 20 and line holes 26 in a slight fan pattern 38 of up to about 3–5° off each side of the horizontal X axis.

As shown in FIGS. 1–4 the line holes 26 are drilled at angle B so that their virtual axes of symmetry 32 intersect with the virtual axes of symmetry 34 of the lifter holes 20.

However, the line holes 26 and the lifter holes do not physically intersect.

After the present drilling pattern is completed, appropriate explosives are loaded into the lifter holes 20 and subsequently detonated.

The present lifter line drilling technique is used not to protect the floor 16 of the heading 12 from damage but to induce damage to the floor 16 below the lifter holes 20. The unloaded line holes 26 act as crack indications where compression waves generated from the nearest lifter holes are reflected and concentrated as tensile waves used to "fail" the rock between the predetermined horizontal planes (28 and 30) and the nearest lifter hole.

Parallel line drilling has been used in industry for cautious blasting close to the existing buildings and other structures. This technique is used to protect the area of concern by preventing the energies from the blast holes from damaging the zone behind the line drilled holes. The line drilled holes create a barrier where much of the blasting energy cannot pass.

However, existing line drilling is not used for development drifting but only for initial blasting as protection of surrounding areas. In contrast, instead of alleviating damage, the present invention encourages useful destruction.

A series of drilling tests demonstrated the efficacy of the present inclined lifter line method. As opposed to the conventional method of employing an array of parallel holes of even length which are useful only in relatively soft rock environments, the instant technique of inclined "expendable" small, lower line holes and longer top lifter holes may be used in all types of rock formations.

Although each mining situation is different, experience suggests, for example, that in typical rock conditions encountered in Sudbury, Ontario, Canada, the line holes 26 are about 48–64 mm (1.89–2.51 inches) in diameter with a pitch angle B of about 3–4%. The length of the line holes 26 is generally a function of the rock. For softer and/or broken rock, their length would range from about 1.83 m (6 feet) to less than about 4.88 m (16 feet) whereas in harder competent rock the length would range from about 1.52 (5 feet) to 2.44 m (8 feet).

The spacing of the line holes 26 (center to center) is again a formation of the ground conditions but typically would be about 20–25 cm (7.87–9.84 inches) apart.

The lifter holes 20 would be typically about 48–64 mm (1.89–2.51 inches) in diameter and about 3.05 m (10 feet) to 4.88 m (16 feet) in length.

The spacing of the lifter holes 20 (center to center) generally follow industry standards—about 0.9–1.2 meters (3–4 feet). The height of the longitudinal band 36 from the base 22 ranges up to about 0.76 meters (2.5 feet).

The present inclined method showed excellent results in hard rock conditions. The closely spaced explosive laden lifter holes 20 had full extraction of the base 22 of a standard round (22.5 $m^2$ [242.2 $ft^2$]). This results in a clean face for the next round and only adds about 52 meters (170.6 feet) additional drilling to a standard round.

Although a substantially horizontal heading 12 is depicted, the process may be applied to a heading directed at any angle. The reference X and Y axes are arbitrary constructs. For example, if the heading 12 is a vertical shaft, the dominance of the X and Y axis would, of course, be switched but the gravamen of the process, a stacked arrangement of a plurality of angled blast holes 20 intersected by less angled lifter holes 26 along a single plane or side of the shaft, remains the same. Similarly the base 22 is actually at the point of attack for the method. In a substantially horizontal heading 24, the base 22 is at the "bottom" of the vertical tunnel face 10. As the heading 12 becomes more vertical, the notion of bottom of the tunnel face begins to rotate. In a completely vertical shaft, the "base" 22 is actually a section such as a peripheral perimeter wall or walls where the lifter and line holes are angled drilled into. Accordingly, the word "base" is broadly construed to include a section of the face 10 where the line holes 20 are to be drilled.

While in accordance with the provisions of the statute, there are illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A method for excavating and advancing into a rock surface to form an excavation, the method comprising:

(a) providing a tunnel face in the excavation having a base and a first reference axis, the first reference axis substantially parallel with the heading direction of the excavation;

(b) drilling a plurality of lifter holes having a first axis of symmetry into the tunnel face at a first acute angle with respect to the first reference axis along a first longitudinal band at the tunnel face;

(c) drilling a plurality of line holes having a second axis of symmetry into the tunnel face at a second acute angle with respect to a second reference axis along a second longitudinal band at the tunnel face opposedly adjacent to the first longitudinal band of lifter holes, the second acute angle smaller than the first acute angle;

(d) drilling the lifter holes deeper than the line holes, causing the lifter holes to be longer than the line holes;

(e) causing the first and second reference axis to be parallel with one another;

(f) drilling the lifter holes and the liner holes so that their first and second axis of symmetry respectively converge within the rock surface while the lifter holes and the line holes do not physically intersect;

(g) loading explosive charges in the lifter holes only; and (h) detonating the explosive charges.

2. The method according to claim 1 wherein the number of line holes exceeds the number of lifter holes.

3. The method according to claim 1 including drilling the lifter holes and the line holes in a fan pattern into the rock surface.

4. The method according to claim 1 wherein the line holes are disposed between the longitudinal band and the base of the tunnel face.

5. The method according to claim 1 wherein the line holes are drilled adjacent to the base of the tunnel face.

6. The method according to claim 1 wherein the first and second acute angles are inclined towards the base of the tunnel face.

7. The method according to claim 1 wherein the first and second acute angles are inclined downwardly in a substantially horizontal excavation heading.

* * * * *